United States Patent [19]

Orban

[11] Patent Number: 4,643,918

[45] Date of Patent: Feb. 17, 1987

[54] CONTINUOUS PROCESS FOR THE METAL COATING OF FIBERGLASS

[75] Inventor: Ralph F. Orban, Columbus, Ohio

[73] Assignee: Material Concepts, Inc., Columbus, Ohio

[21] Appl. No.: 729,850

[22] Filed: May 3, 1985

[51] Int. Cl.[4] ..... C23C 18/30

[52] U.S. Cl. ..... 427/304; 8/139; 204/14.1; 204/21; 204/38.4; 427/305; 427/306; 427/322; 427/436; 427/404

[58] Field of Search ..... 428/263, 268; 427/304–306, 322, 436, 404; 8/139; 204/14.1, 21, 38.4

[56] References Cited

U.S. PATENT DOCUMENTS

| | | | |
|---|---|---|---|
| 3,442,694 | 5/1969 | Sooline | 428/267 |
| 4,340,382 | 7/1982 | Morlino | 8/137 |

FOREIGN PATENT DOCUMENTS

| | | | |
|---|---|---|---|
| 47-6078 | 2/1972 | Japan | 427/304 |
| 49-27700 | 3/1974 | Japan | 427/306 |
| 2080338 | 2/1982 | United Kingdom | 427/305 |

*Primary Examiner*—John D. Smith
*Attorney, Agent, or Firm*—John L. Gray

[57] ABSTRACT

A method of preparation of fiberglass filaments for subsequent coating with metal wherein the fiberglass filaments first are immersed in a wetter solution containing alcohol, a detergent, and an ethylene oxide and propylene oxide copolymer surfactant. Following this treatment the filaments may be treated with conventional palladium chloride or tin chloride activators, followed by treatment with an acid accelerator and then autocatalytically coated with metals such as copper, gold, palladium, cobalt, nickel, and nickel alloys of phosphorus, boron, or tungsten. A second electroplating or immersion plating step may be included where the metal-coated filaments are electroplated or immersion plated with either the same metal, or a different metal taken from the group consisting of nickel, silver, zinc, cadmium, platinum, iron, cobalt, chromium, tin, lead, rhodium, ruthenium, or iridium. The filaments are rinsed with water following immersion in the wetter solution and after each plating step and then finally are rinsed with alcohol and dried.

7 Claims, 1 Drawing Figure

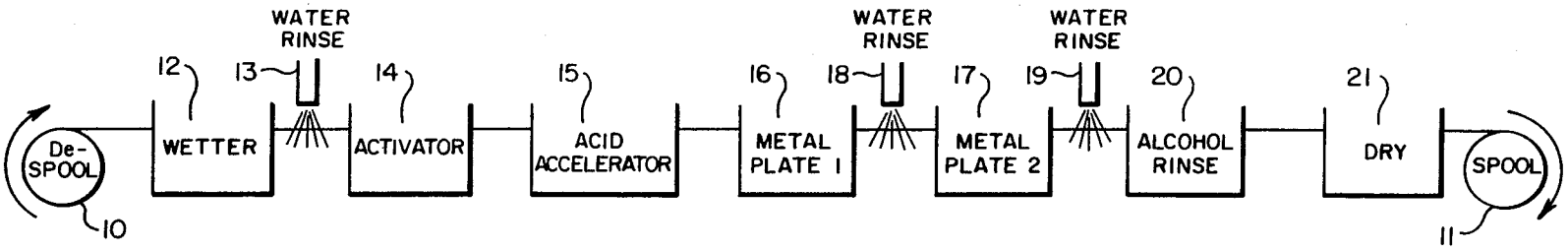
De-SPOOL
10
WETTER
12
WATER RINSE
13
ACTIVATOR
14
ACID ACCELERATOR
15
METAL PLATE 1
16
WATER RINSE
18
METAL PLATE 2
17
WATER RINSE
19
ALCOHOL RINSE
20
DRY
21
SPOOL
11

CONTINUOUS PROCESS FOR THE METAL COATING OF FIBERGLASS

BACKGROUND OF THE INVENTION

It is desirable for certain applications to have an electrically conductive coating on fiberglass. Usually the fiberglass is in the form of multi-filament tows or roving.

Attempts to coat fiberglass filaments with a variety of metals have been tried in the past with little success. Such patents as U.S. Pat. Nos. 3,038,248, Kramer, and 4,368,221, Mihaly, et al., are examples of disclosures in this area. The Mihaly, et al. patent utilizes a pretreatment with a 1 to 4 carbon aliphatic alcohol and is limited to the application of amorphus nickel phosphorus to fiberglass.

SUMMARY OF THE INVENTION

The invention relies on the fact that, with a pretreatment of a mixture of alcohol, which is preferably isopropyl alcohol, a detergent and a surfactant where the surfactant is an ethylene oxide and propylene oxide copolymer, it is possible to obtain intimate adherence of a great variety of different metals to fiberglass filaments. The particular surfactant that has been used is sold by BASF, Wyandott under the Pluronic series trademark. After the fiberglass filaments have been immersed in the wetter solution, they are rinsed with water and then treated in the normal fashion with an activator such as palladium chloride or tin chloride, following which they are treated with an acid accelerator in the usual fashion. Then the filaments may be plated with metals such as copper, gold, palladium, cobalt, nickel, and nickel alloys of phosphorus, boron, or tungsten.

A second plating step may be employed following the water rinsing of previously metal-coated filaments and in this case the plating step may be used to plate either the same metal as was previously plated on the filaments or a different metal taken from the group including nickel, silver, zinc, cadmium, platinum, iron, cobalt, chromium, tin, lead, rhodium, ruthenium, and iridium. Following such plating process, the filaments would be rinsed with water, then rinsed with alcohol, and then dried.

It is therefore an object of this invention to prepare fiberglass filaments for subsequent coating with a variety of metals.

It is also an object of this invention to provide a process for coating multi-filament fiberglass tows or roving with a variety of electrically conductive metals so that the resultant tow or roving is electrically conductive.

It is a further object of this invention to provide such a process which is a continuous process.

These, together with other objects and advantages of the invention, should become apparent in the details of construction and operation, as more fully described herein and claimed, reference being had to the accompanying drawing forming a part hereof wherein like numerals refer to like parts throughout.

BRIEF DESCRIPTION OF THE DRAWING

The drawing is a flow chart of the processing steps involved in the preferred embodiment of the invention.

DETAILED DESCRIPTION OF THE INVENTION

Referring now more particularly to the drawing, the multifilament fiberglass tow or roving is wound on the spool 10 and unwound from this spool 10 by the action of windup spool 11 and continuously moved through the various processing steps using conventional sealing techniques.

The first step involves immersing the fiberglass filaments in the wetter solutions shown at 12. The wetter solution comprises commercial water and isopropyl alcohol solutions containing a detergent and a small amount (in the order of one-half to one percent) of ethylene oxide and propylene oxide copolymer surfactant. This step is then followed by a water rinse 13 and the fiberglass filaments are then introduced into the activation catalyst bath 14. This is a commercial palladium chloride or tin chloride or mixture in hydrochloric acid water solution and among other sources is available from Ethone Corporation and is identified as Enplate Activator 443. The fiberglass filament then is introduced into the acid accelerator bath 15, which contains a commercial accelerator such as that available from Enthone Corporation and identified as Post Activator PA-491. The metal plate baths 16 and 17 are readily available commercial systems that may utilize autocatalytic coating, electroplating, or immersion plating. Water rinses 18 and 19 follow each metal plating bath and then the fiberglass filaments are rinsed in alcohol in the alcohol rinse bath 20, which preferably contains isopropyl alcohol, and then are dried in the oven 21.

The following examples will illustrate the advantages of the invention:

EXAMPLE 1

The fiber transport system shown in the drawing was set to produce the following desired resident times in the specific solutions:

1. Wetter, two minutes
2. Activator, two minutes
3. Acid Accelerator, two minutes
4. Metal Plate, one minute (Autocatalytic Copper, 15 to 20 minutes)
5. Metal Plate, Cyanide Copper, two minutes
6. Alcohol Rinse, one minute
7. Drying, two minutes In each of the examples, these resident times were utilized and water rinses were used after the wetter and after each of the metal plating steps. The fiberglass was multi-filament S-glass roving. The autocatalytic copper was a commercial copper bath containing copper, hydroxide, 37 percent formaldehyde; the temperature of the bath was 70°–90° F.; pH was 12–13, and this bath is available commercially from Enthone Corporation and identified as Enplate Cu-404. The cyanide copper bath was a high-speed bath containing 80 grams/liter of copper cyanide; 100 grams/liter of sodium cyanide; and 26 grams/liter of potassium hydroxide.

Utilizing the above resident times and the above-identified materials, the autocatalytic copper deposited a fine-grained, shiny copper with good adhesion on the substrate. Additional copper deposited by the cyanide copper solution was also fine grained and shiny and coverage of the substrate was 99.9 percent. Resistances of 1 ohm per foot or less were easily achieved.

EXAMPLE 2

The same conditions, substrate, and solution compositions were used as in Example 1, except that the wetter step was omitted. The result was that the autocatalytic deposits were very spotty with poor adhesion and the attempts at depositing the cyanide copper were equally poor.

EXAMPLE 3

The same conditions, substrate, and solution compositions as in Example 1 were used, except that the wetter contained isopropyl alcohol, water, and a detergent. Slightly better results were achieved than in Example 2 but the product was not satisfactory.

EXAMPLE 4

The same conditions, substrate, and solution compositions were used as in Example 1, except in addition the copper-coated substrate was passed through a silver cyanide solution. The silver deposited onto the copper with good results, was of high-quality, and there was good coverage.

According to accepted methods of autocatalytic coating, water rinses are normally used after the activator step 14; however, it has been found that whether or not the wetter is used, such water rinses are detrimental to the process, as will be seen from the following examples:

EXAMPLE 5

The same conditions, substrate, and solution compositions were used as in Example 1 except that the wetter step 12 was omitted and water rinses were employed after activator step 14 and acid accelerator 15. No coating was obtained.

EXAMPLE 6

The same conditions, substrate, and solution compositions were used as in Example 1 except that both the wetter step 12 and the water rinses after activator step 14 and acid accelerator 15 were omitted. No coating was achieved on the substrate.

EXAMPLE 7

The same conditions, substrate, and solution compositions were used as in Example 1 except that the wetter step 12 was included and water rinses were used after the activator step 14 and acid accelerator 15. No coating was achieved on the substrate.

It will thus be seen that by practicing this invention, good quality adherent coatings on fiberglass filaments utilizing a variety of metals may be achieved.

While this invention has been described in its preferred embodiment, it is appreciated that variations thereon may be made without departing from the true scope and spirit of the invention.

What is claimed is:

1. A method of continuously coating fiberglass filaments with metal comprising the steps of:

immersing said filaments in a wetter solution containing alcohol, a detergent and an ethylene oxide and propylene oxide copolymer surfactant, rinsing said filaments with water, treating said filaments with an activator selected from the group consisting of palladium chloride and tin chloride, treating said filaments with an acid accelerator, coating said filaments with a metal selected from the group consisting of copper, gold, palladium, cobalt, nickel, and nickel alloys of phosphorus, boron, or tungsten, rinsing said filaments with water, rinsing said filaments with alcohol, drying said filaments.

2. The method of claim 1 wherein, immediately prior to rinsing said filaments with alcohol, said metal-coated filaments are coated with a second metal, which metal is the same as the metal first used to coat said filaments, then rinsing said thus coated filaments with water.

3. The method of claim 2 wherein said filaments are coated by a process selected from the group consisting of autocatalytic coating, electroplating, and immersion plating.

4. The method of claim 1 wherein said alcohol is isopropyl alcohol.

5. The method of claim 1 wherein the filaments are coated by a process selected from the group consisting of autocatalytic coating, electroplating, and immersion plating.

6. A method of continuously coating fiberglass filaments with metal comprising the steps of:

immersing said filaments in a wetter solution containing alcohol, a detergent and an ethylene oxide and propylene oxide copolymer surfactant, rinsing said filaments with water, treating said filaments with an activator selected from the group consisting of palladium chloride and tin chloride, treating said filaments with an acid accelerator, coating said filaments with a metal taken from the group consisting of copper, gold, palladium, cobalt, nickel, and nickel alloys of phosphorous, boron, and tungsten, rinsing said filaments with water, coating said metal-coated filaments with a metal selected from the group consisting of nickel, silver, zinc, cadmium, platinum, iron, cobalt, chromium, tin, lead, rhodium, ruthenium, and iridium, rinsing said filaments with water, rinsing said filaments with alcohol, drying said filaments.

7. The method of claim 6 wherein said filaments are coated by a process selected from the group consisting of autocatalytic coating, electroplating, and immersion plating.

* * * * *